United States Patent [19]

Spence

[11] Patent Number: 4,534,522

[45] Date of Patent: Aug. 13, 1985

[54] SPOOL RETAINING DEVICE

[76] Inventor: Robert L. Spence, 808 Birch Ave., Escondido, Calif. 92027

[21] Appl. No.: 662,032

[22] Filed: Oct. 18, 1984

[51] Int. Cl.[3] ..... B65H 55/00; B65H 75/28

[52] U.S. Cl. ..... 242/172; 242/125.3

[58] Field of Search ..... 242/172, 159, 125.3, 242/125.2, 125.1, 125, 170, 171; 206/389, 53, 409

[56] References Cited

U.S. PATENT DOCUMENTS

| | | | |
|---|---|---|---|
| 358,675 | 3/1887 | Kenyon et al. | 242/125.3 |
| 583,176 | 5/1897 | Harvey | 242/125.3 |
| 1,222,703 | 4/1917 | White | 242/125.3 |
| 1,923,456 | 8/1933 | Price | 242/170 X |

FOREIGN PATENT DOCUMENTS

| | | | |
|---|---|---|---|
| 1084077 | 6/1954 | France | 242/125.3 |
| 21553 | of 1893 | United Kingdom | 242/125.3 |
| 6233 | of 1898 | United Kingdom | 242/125.3 |
| 10681 | of 1913 | United Kingdom | 242/125.3 |
| 225706 | 12/1924 | United Kingdom | 242/125.3 |
| 257511 | 9/1926 | United Kingdom | 242/125.3 |

*Primary Examiner*—Stanley N. Gilreath

*Attorney, Agent, or Firm*—John J. Murphey

[57] ABSTRACT

A device that is placed upon a large spool of line or other wound material to control the alignment of the line as it is unwound therefrom comprising a first means defining an aperture through which the unwinding line passes and second means for holding said first aperture loosely adjacent about the outer windings intermediate the ends of the spool to allow it to slip around the spool during unwinding.

4 Claims, 7 Drawing Figures

SPOOL RETAINING DEVICE

FIELD OF THE INVENTION

This invention pertains to the field of line control devices. More particularly, this invention pertains to devices that are used to control the position of line as it unwinds from a spool such as in the utility field where electricians unwind wire from large spools and pass it into conduit for installation in or around a building.

BACKGROUND OF THE INVENTION

In the field of spool-wound materials, such as in the electric field, as aforesaid, large, heavy spool of wire of various diameters, are strung on a central axle and positioned on a cart that the electrician pushes around the building, from which wire is unwound or stripped and fed into electrical conduit pipes. The normal practice is to hang the metal conduit pipes all through the building and thereafter insert the wires through the conduit to their ultimate destination at a power panel or electrical outlet and so forth.

The electrician's helper pulls or strips the wire from the spools and passes it to the electrician who is up on a ladder at the entrance way into the conduit. Under ideal conditions, the electrician unwinds the wire from the spools by pulling it and then slides it into and through the conduit to his helper at the other end. In reality, the heavy spools over-speed or over-rotate on the thin axle (usually just a length of pipe supported on crude 2"×4" studs nailed together) and the wire unwinds too much so that as the spool rotates, the wire quickly winds around and becomes entangled in the axle causing the electrician to interrupt his work and get down from the ladder and counter-rotate the spool and rewind the wire onto the spool.

Not only does this over-rotation of the spool and the tangling of the wire around the axle cause a loss of time for the electrician, but the wire frequently becomes kinked or the sheath splits, where it snagged around the axle, and this snag must either be cut out and removed from the line or the whole wire pulled out of the conduit and the process started over again. In addition, the wire frequently gets dirty, covered with oil or other spilled material at the construction site, and thereafter may hangup in the conduit causing loss of installation time and many frayed tempers.

DESCRIPTION OF THE PRIOR ART

The following prior art is known by the inventor:

| U.S. PAT. NO. | INVENTOR | COUNTRY |
|---|---|---|
| 358,675 | Kenyon et al | U.S.A. |

A narrow spring metal clip for positioning over smooth wound spools of thin thread having a centrally located vertical slot through which the thread passes; the clip is used to hold the thread on the bobin and not to let it unwind therefrom when the bobin is not in use.

| | | |
|---|---|---|
| 583,176 | H. D. Harvey | U.S.A. |

A narrow wire encircling the circumference of a smooth wound spool of thin thread having a small loop at one end through which the thread passes to be held on the spool and prevented from being unwound and entangled.

| | | |
|---|---|---|
| 1,222,703 | J. White | U.S.A. |

A pliable sleeve for fitting over the entire surface of a spool of smoothly wound thin thread and having a centralized aperture lined with a grommet through which the thread passes out to a thread-using device. The sleeve must ride smoothly on the beveled inside surface of the spool ends to achieve a uniform rotation speed to be able to match the aperture with the point of departure of thread from the spool.

None of these aforesaid patents are useable on reels or spools of thick and rough surfaced electrical wire or rope in the case of a spool of rope. Kenyon et al requires the spring clip to embrace the spool within its two spring arms (col. 1, lines 24–25), and the arms are to be compressed against the surface of the wound thread (col. 1, lines 43–44). In use, the clip is grasped by one hand and the thread pulled off the spool with the other hand, the spool being supported in the user's hand (col. 2, lines 92–97). In the invention soon to be described, the control device is mounted on a spool of wire weighing as much as many hundreds of pounds and therefore incapable of supporting the spool during use.

The thread holder of Harvey is incapable of use with electric wire-wound spools or rope-wound spools because the wire would sink into the crevices between the thick wires. Also the loop is in a plane that is perpendicular to the axle running through the spool (col. 1, lines 40–43) and is 90° out of position for passage of heavy electrical wire or rope therethrough. Finally, the wire will not slip easily over the large, sometimes 3-foot diameter, of the spool without a great deal of effort which is antithetical to the spirit of Harvey's invention.

The flexible sleeve of White's invention must be slipped over the end of the reel and, with the large reels contemplated in the instant invention, it is virtually impossible to do so. Further, White's invention is predicated upon the sleeve slipping easily and smoothly along the smooth, beveled surfaces of the inside end plate of the spool. The instant invention is contemplated for use on large, cumbersome spools of heavy electrical wire and rope and these spools have crude plywood panels as end plates that contain many burrs and gouges. Thus, White's sleeve would hang-up on the non-smooth surface and not turn smoothly thus frustrating the very operativeness of the invention.

SUMMARY OF THE INVENTION

This invention is a device that encircles a large spool of wire or other line or strand material wound thereon to control the alignment of the line as it is unwound therefrom. The device rotates around the surface of the wound line and not against the ends so that the chances of hanging up on burrs and splinters of wood from the crude end plates is averted.

The device prevents wire from overshooting the reel as it unwinds and prevents it from becoming entangled around the axle and also will not develop kinks and bends as happens with the present practice. The device of this invention comprises a first means that defines an aperture that rides around the circumference of the reel as the line unwinds therefrom, and a second means for holding the aperture loosely adjacent the outer surface of the wrapped line or wire so that the aperture is always aligned with the departing line in a direction toward the entrance to the next operation such as toward the conduit in which it is to enter. The device may be easily placed around the spool of wire and just as easily removed when not needed. Some of the embodiments of this invention allow rewinding of non-used material onto the reel or spool while using the invention to prevent overrun or entanglement of the material around the axle.

Accordingly, the main object of this invention is a device for placement about the surface of a spool of wire or other wound material for use in aligning the departing line as it unwinds therefrom. Another object is a device or placement between the ends of the spool to prevent entanglement of the material about the support axle of the spool and prevent the creation of bends and kinks therein. Other objects of the invention include a device useful on a variety of reels and spools, a device that is reusable, a device that maintains the material in a clean and ready-to-use configuration, and a device that has many embodiments to allow it to perform a variety of functions with a variety of wires, ropes and other materials.

These and other objects of the invention will become more apparent to the reader when the specification is read in light of the drawings that are appended hereto. The scope of protection claimed by the inventor can be judged by a fair reading of the claims that conclude this specification.

DESCRIPTION OF THE PREFERRED EMBODIMENT

Figure 1:
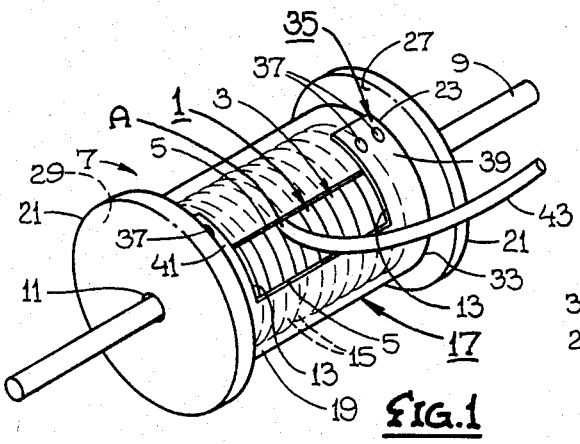
FIG. 1 is a perspective view of one embodiment of the invention.

FIG. 1 shows one of the devices of this invention and shows first means 1 defining an aperture 3, shown here of rectangular size with a pair of parallel edges 5, parallel and aligned with a central axle 9 passing through the centerd 11 of reel 7, and a pair of parallel edges 13 running vertically along the wraps or coils 15 of wire or line wrapped about reel 7.

A second means 17 is shown as a band or sleeve 19 wrapped around coils 15 intermediate spool end plates 21 having a pair of side edges 23 and 25, respectively, that are spaced inward from the inside surfaces 27 and 29 of end plates 21 so that there is little if any contact therebetween. Sleeve 19 may be made from a wide variety of materials that have the quality of being flexible and having a low coefficient of surface friction on the surface adjacent the coils of line on spool 7, such as polyethylene, or polyvinylchloride (pvc) sheeting heat formed into a cylindrical sleeve shape. Sleeve 19 has first and second end edges 31 and 33 respectively that are held in fixed geometry by third means 35, shown in FIG. 1 as two pairs of male/female snaps 37 separately mounted on a pair of tabs 39 and 41, that extend from the ends of end edge 31, and along side edges 23 and 25 near end edge 33, adapted to be intersnapped into a fixed configuration.

Sleeve 19 is of a diameter slightly larger than a full spool to allow it to position aperture 3 loosely adjacent about the outermost wires of coils 15 so that, as line 43 is stripped off reel 7, its divergence from the circular shape of coil 15, noted at point A, drives sleeve 19 in a direction opposite to that of reel 7 as reel 7 rotates to give up line. The rotational speed of sleeve 9 is identical to that of reel 7 resulting in aperture 3 always facing in the direction of departing line 43 and the direction where line 43 is to be next used such as being inserted into electrical conduit and the like.

Figure 2:
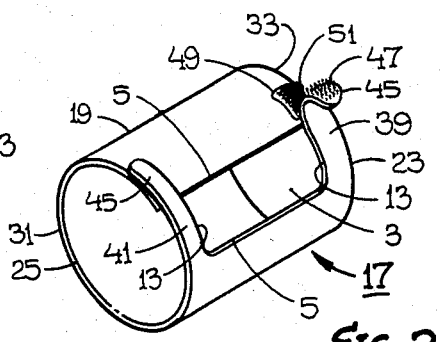
FIG. 2 is a view of the embodiment shown in FIG. 1 and showing a different method of securing the end tabs of the sleeve about the circumference of the spool or wire.

FIG. 2 shows a similar arrangement to FIG. 1 except that tabs 39 and 41 are connected to side edges 23 and 25 near end edge 33 through a pair of strips 45 of flexible material such as fabric connected to the underside of tabs 39 and 41, equipped with a large plurality of loop elements 47, which extend toward reel 7 and side edges 23, 25. A corresponding strip or patch of material 49 comprising a plurality of hook elements 51 is affixed to the external surface of side edges 23 and 25. The loop 47 and the hooks 51 are resilient and deformable and when pressed together become removeably entangled, securing tabs 39 and 41 to side edges 23 and 25 and thus fixing the geometry of first end edge and second end edge 31 and 33. Loops 47 and hooks 51 can be released from entangled engagement by positively pulling up on tabs 39 and 41 to pull hooks 51 from loops 47 or vice versa. The loop and hook fabric elements 45 and 49 are available under the trademark "Velcro", more specific details of which may be had from U.S. Pat. No. 2,717,437 to George de Mestral and U.S. Pat. No. 3,114,951 issued Dec. 24, 1963 to George de Mestral.

Figure 3:
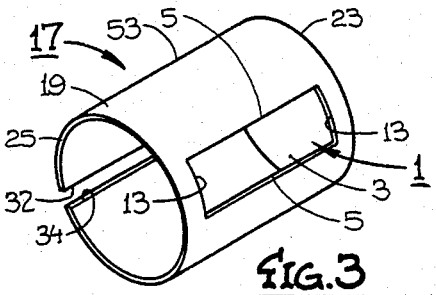
FIG. 3 is another embodiment of the device of this invention.

FIG. 3 shows another embodiment of means 17 comprising a cylindrical sleeve 53 of semirigid material, such as the aforesaid polyethylene or polyvinyl chloride sheeting, heat formed into said sleeve shape, having edges 32 and 34 spaced apart from aperture 3 and said aperture's bordering edges 5,5, 13 and 13 shown to form a rectangular opening. Sleeve 53 can be pried open along opposed edges 32 and 34 and slipped over the line-wound spool 7 whereupon because of its semirigid nature, it would snap back into its original heat-formed configuration to present aperture 3 always facing in the direction of departing line 43.

Figure 4:
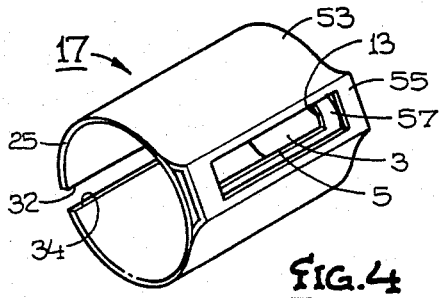
FIG. 4 is another embodiment of the device of this invention showing reinforcement about the aperture.

FIG. 4 shows another embodiment of means 17 wherein aperture 3 is reinforced against erosion caused by rough-surfaced lines as it is stripped from the reel. Said reinforcement is shown as a second layer 55 glued or heat sealed to sleeve 53 and having an aperture 57 formed therein of equal size and shape to aperture 3 and set above aperture 3. Said reinforcement reduces the wear along aperture edges 5 and 13 caused by departing line (not shown) to prolong the life of said device.

Figure 5:
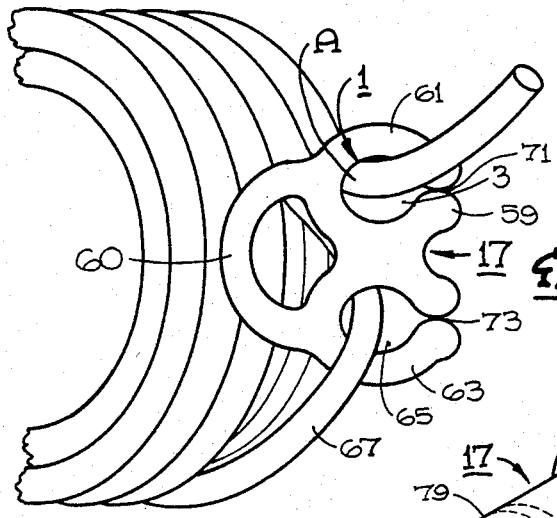
FIG. 5 is another embodiment of the device of this invention showing a different configuration of the first and second means.

FIG. 5 shows another embodiment of the device of this invention wherein said first means 1 and said second means 17 comprise a single solid element 59 having an upper arm 61, fashioned into a hook shape to form aperture 3 therein, and a lower arm 63, fashioned into another hook shape to form a second aperture 65. It is preferable that apertures 3 and 65 lie in a common plane. The last full coil 67 of line on spool 7 is threaded through aperture 65 and then the departing line is looped over spool 7 and threaded through aperture 3. The divergence of departing line, at A, will hold element 59 loosely adjacent the outer coils of spool 7 and further will maintain the departing line intermediate spool end plates 21 and prevent over-rotation and loss of line from spool 7.

A handle is added between upper arm 61 and lower arm 63 and extends outward from element 59 to aid in retaining element 59 in operable position when rewinding line or spool 7 by rotating spool backward and feeding line in through aperture 3. A pair of slots 71 and 73 are cut or molded at the terminal ends of upper arm 61 and lower arm 63 from outside element 59 into aperture 3 and 65 respectively to allow the user to bend arms 61 and 63 outward and slip the lines therethrough for quick threading. Without these slots, the line must be threaded through the apertures endwise.

Figure 6:
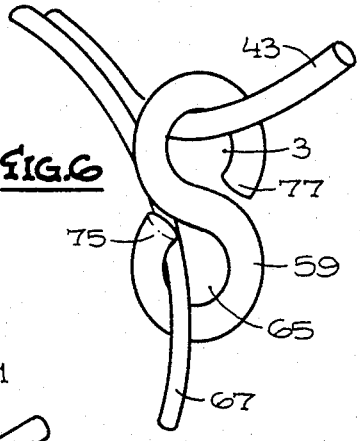
FIG. 6 is another configuration of the embodiment shown in FIG. 5.

FIG. 6 shows another embodiment of the device of this invention showing element 59 to be formed into an "S" shape with the ends 75 and 77 of the "S" to be formed to be close to or touch the main body of element 59 and form apertures 3 and 65 therein. Said element 59 is positioned over the last coil 67 and departing line 43 by threading the lines through aperture 3 and 65 or by passing the lines in through the narrow opening between ends 75 and 77 and element 59.

Figure 7:
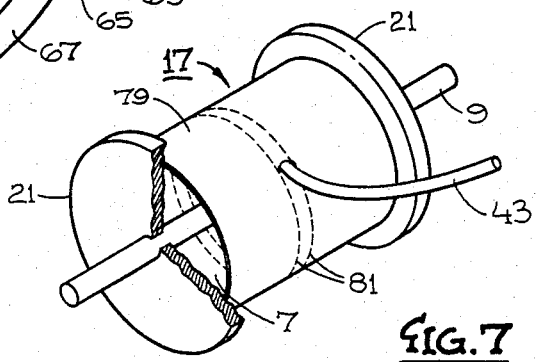
FIG. 7 is still another perspective view of another embodiment of this invention.

FIG. 7 shows another embodiment of the device of this invention showing second means 17 to be a sleeve 79 of soft, flexible material, such as light weight (2 mil) plastic that is heat sealed over coils 15 of spool 7 and that contains at least one line or slit and preferably two lines such as perforations 81 encircling coils 15 and substantially midway between spool end plates 21. The departing line 43 pulled out from coils 15 through perforations 81 and sleeve 79 rotates with coils 15 and spool 7 to allow departing lien 43 to be channeled from along the breadth of coils 15 into the slit to retain line 43 somewhat intermediate ends 21.

What is claimed is:

1. In combination with a spool having strand material wound thereon, a device for retaining the strand material intermediate the ends of the spool during unwinding of the strand material from the spool; said device comprising an element having two spaced apart apertures formed therethrough, each aperture larger than the strand material on said spool; an end of said strand material passing through one of said apertures, around said spool and through the other of said apertures, whereby the strand material extending from the other of said apertures diverges from the strand material extending through said one of said apertures during unwinding to maintain said element loosely adjacent the outer windings of said strand material on said spool and to allow said element to slip around said spool during unwinding.

2. The device of claim 1 wherein said two, spaced-apart apertures lie in a common plane.

3. The device of claim 1 wherein said element includes a pair of slots, one extending from each aperture out the side thereof toward an end of the spool, substantially narrower than the strand material on the spool to permit said element to be flexed slightly and the said slots opened so that the strand material may be passed from outside said element into the respective apertures.

4. The device of claim 1 including a handle extending outward from said element to aid in holding and controlling said element when rewinding unused strand material back on the spool.

* * * * *